US005273165A

United States Patent [19]

Krenzler

[11] Patent Number: 5,273,165

[45] Date of Patent: Dec. 28, 1993

[54] ROTATING GOLD PAN FOR SEPARATING GOLD PARTICLES FROM ORE

[76] Inventor: Leo M. Krenzler, 1142 Industry Dr., Seattle, Wash. 98188

[21] Appl. No.: 817,134

[22] Filed: Jan. 6, 1992

[51] Int. Cl.[5] ..... B03B 5/02

[52] U.S. Cl. ..... 209/434; 209/444; 209/451; 209/508

[58] Field of Search ..... 209/413, 414, 434, 444, 209/451, 484, 505, 508

[56] References Cited

U.S. PATENT DOCUMENTS

| | | | |
|---|---|---|---|
| 267,049 | 11/1882 | Wilson | 209/414 |
| 1,081,421 | 12/1913 | Arnold | 209/431 X |
| 1,985,513 | 12/1934 | McCleery | 209/444 X |
| 4,389,308 | 6/1983 | Cleland | 209/444 |
| 4,406,783 | 9/1983 | Cleland | 209/444 |
| 4,517,079 | 5/1985 | Cleland | 209/444 X |
| 4,642,180 | 2/1987 | Kaufman | 209/414 X |

FOREIGN PATENT DOCUMENTS

| | | | |
|---|---|---|---|
| 371153 | 3/1923 | Fed. Rep. of Germany | 209/414 |

*Primary Examiner*—Andres Kashnikow
*Assistant Examiner*—Kaufman J. A.
*Attorney, Agent, or Firm*—Delbert J. Barnard

[57] ABSTRACT

A separator pan (10) is set into a rearwardly leaning ng position (FIG. 4). A lower portion of the pan sidewall (28) slopes downwardly as it extends outwardly from the pan bottom (12). A spiral rib (32), inside of the pan (10) slopes upwardly as it extends axially outwardly from the interior of the pan (10). Pan (10) is rotated in a direction causing the spiral rib (32) to coil inwardly. Large particles of gold ore, introduced into the pan (10), gravitate out from the pan, owing to the sloping nature of the lower portion of pan sidewall (28). Smaller particles, including small particles of gold, are trapped between spiral rib (32) and sidewall (28) and bottom wall (10) of pan (10). As the pan (10) rotates, these small particles are moved inwardly and into a hub cup (14).

8 Claims, 3 Drawing Sheets

Fig. 3
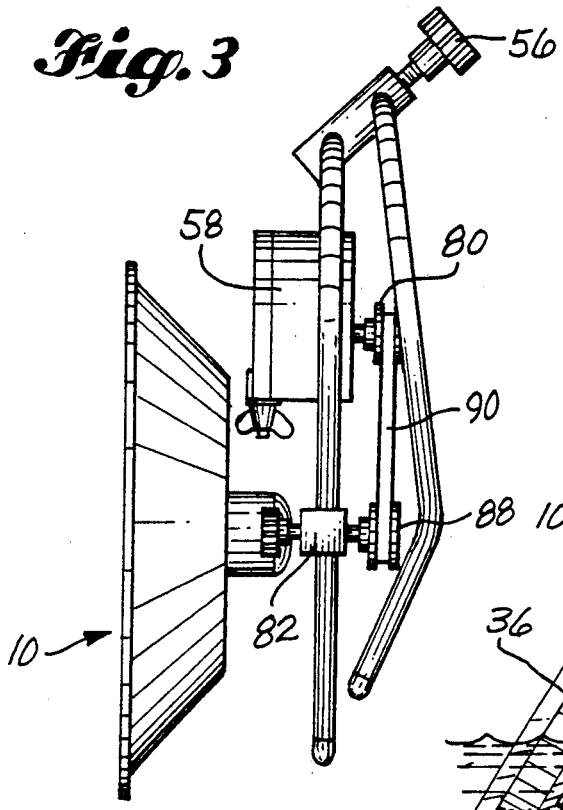
Fig. 4
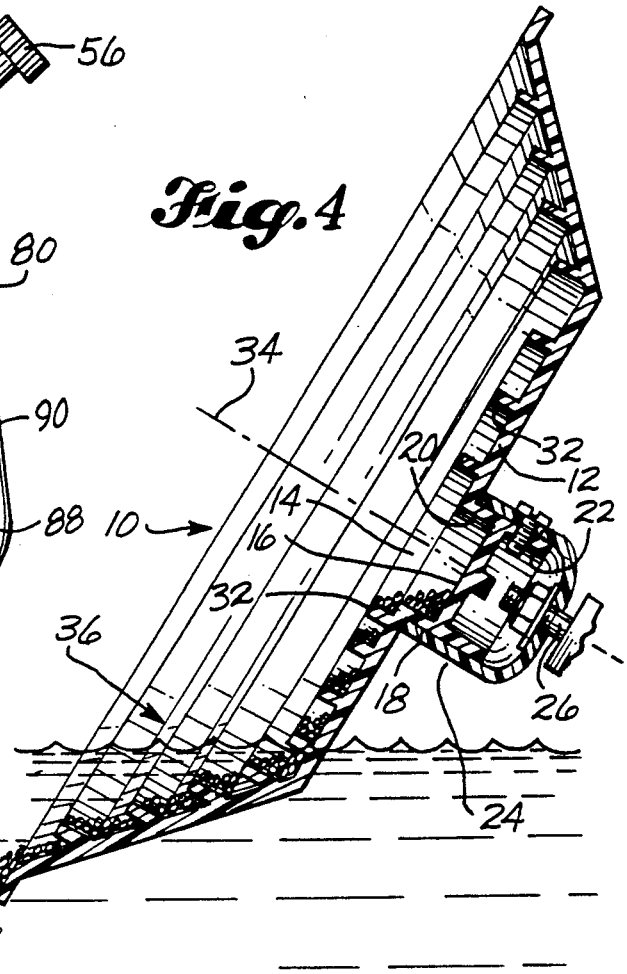
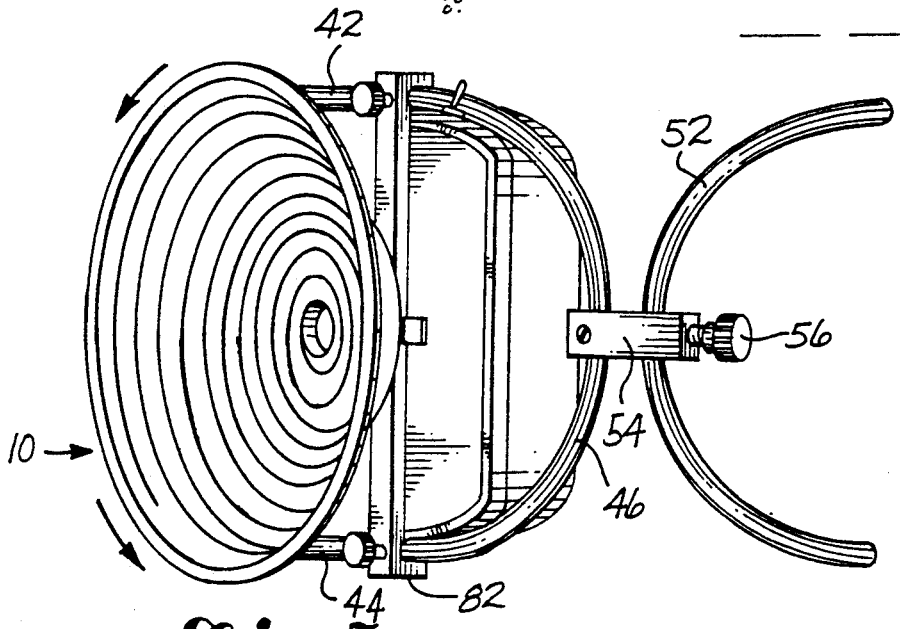
Fig. 5

ROTATING GOLD PAN FOR SEPARATING GOLD PARTICLES FROM ORE

DESCRIPTION

1. Technical Field

This invention relates to the separation of gold particles from gold ore. More particularly, it relates to the provision of a rotating gold pan which includes a spiral rib which moves gold particles into a hub cup while larger particles of gold ore gravitate out from the rotating gold pan.

2. Background Art

Hand-held and hand manipulated gold pans have been used for many years for separating small gold particles from gold ore, and in particular from gold ore found in stream or river beds. This type of gold mining is quite difficult to learn. Also, gold separating by the hand panning method is difficult and tedious even to an experienced gold panner. A principal object of this invention is to provide a rotating gold pan which includes a spiral rib in its interior leading to a hub cup. Gold ore is introduced into the pan as the pan is rotated. Large pieces of the gold ore gravitate out from the pan. Small particles, including gold particles, are moved by a spiral rib, to the center of the pan, into the hub cup.

DISCLOSURE OF THE INVENTION

The separator of the present invention is basically characterized by a rotatable gold pan which includes a bottom, a frusto-conical sidewall, a hub cup at the center of the bottom and a spiral rib which starts from the hub cup and spirals outwardly, first on the bottom of the pan and then on the sidewall of the pan. The pan is mounted onto a frame for rotation about a centerline axis. The pan leans backwards from vertical. The lower portion of the pan sidewall slopes downwardly and outwardly from the bottom of the pan. The spiral rib slopes upwardly and outwardly from the inner surface of the pan. In use, the pan is rotated in a direction causing particles on the spiral rib to move inwardly along the spiral rib towards the hub cup. In use, gold ore is introduced into the lower portion of the pan while the pan is being rotated. The heavy particles of the ore gravitate out from the pan and small gold particles are caught by the rib and are moved by the rib inwardly into the hub cup.

In preferred form, the frame comprises a first frame part and a second frame part. The first frame part includes first and second legs and a top portion interconnecting the first and second legs. The second frame part includes third and fourth legs and a second top part interconnecting the third and fourth legs. A connector interconnects the first and second top parts. The connector is operable to allow movement of the third and fourth legs toward the first and second legs, to collapse the frame for stowage. The connector is also operable for movement of the third and fourth legs away from the first and second legs, to establish an in use position of the two frame members, in which the two frame members diverge apart from the connector and the lower ends of the legs are spaced apart and provide a four point support for the frame.

Also in preferred form, the separator includes a housing connected to the first frame member. The housing contains a drive motor and may also include a battery. The first frame member also includes a lower transverse frame member on which the pan is mounted for rotation. The motor is attached to a first pulley and the pan is attached to a second pulley. A drive belt interconnects the two pulleys.

Preferably, the battery which operates the drive motor is a rechargeable battery. It may be recharged by a source of 110 volt alternating current. Or, it may be charged by a solar powered electrical generator, a portable generator, or any other suitable source of electrical power for recharging the battery. In some installations the battery may be eliminated and another source of electrical energy be directly coupled to the drive motor.

Other objects, features and advantages of the invention are hereinafter described as a part of the description of the best mode.

BRIEF DESCRIPTION OF THE DRAWING

Like reference numerals are used to designate like parts throughout the several views of the drawing, and:

FIG. 3 is a side elevational view of the separator with its frame folded into a second position for stowage;

FIG. 4 is an enlarged scale axial sectional view, taken through the pan, such view clearly showing that the lower sidewall portion of the pan slopes downwardly as it extends outwardly from the bottom of the pan, and further showing that the spiral rib slopes upwardly as it extends generally axially outwardly from the interior of the pan, such view showing small particles on the rib in the process of being moved by the rib to a hub cup at the center of the pan, and such view also showing larger particles gravitating out from the pan;

FIG. 5 is a top plan view of the separator when it is in its use position;

BEST MODE FOR CARRYING OUT THE INVENTION

Figure 1:
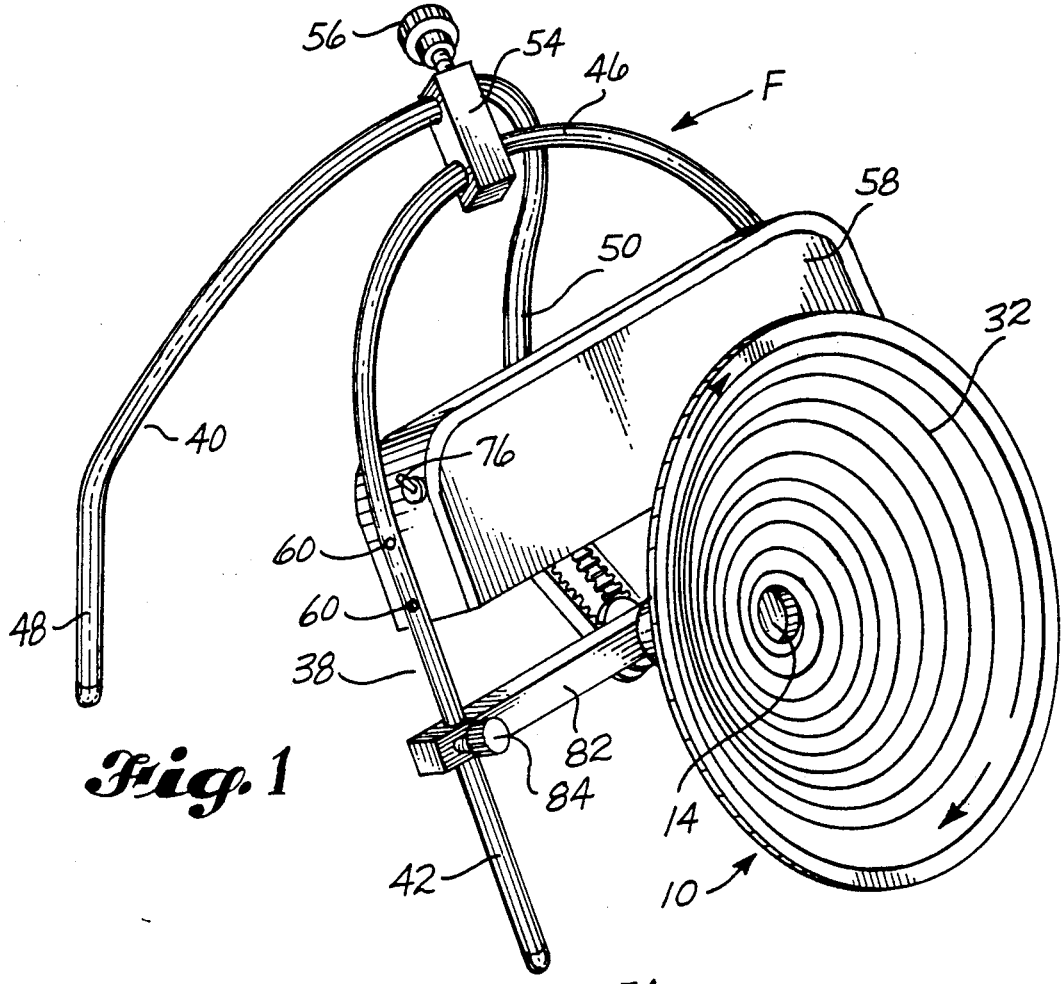
FIG. 1 is a pictorial view of an embodiment of the invention, in its use position, such view being taken from above and looking towards one side and the front of the separator.

The gold separator of the present invention is basically characterized by a separator pan 10. Pan 10 includes a bottom 12 which is substantially flat, except at its center where a hub cup 14 is located. Hub cup 14 may have a planer bottom 16 and a cylindrical sidewall 18. Referring to FIG. 4, cylindrical sidewall 18 is shown to include a forward portion 20 which interconnects bottom 16 with bottom wall 12. Cylindrical wall 18 also includes a rear portion 22 which extends axially rearwardly from bottom 16. As shown by FIG. 4, wall 18 fits snugly into a drive member 24. Drive member 24 is secured to a pan shaft 26 which will hereinafter be described.

Separator pan 10 includes a frusto-conical sidewall 28. Sidewall 28 has a small diameter end at which it is connected to bottom wall 12 and it increases in diameter as it extends axially outwardly from bottom wall 12, to a large diameter outer end. Pan 10 may also include a lip 30 at the outer end of sidewall 28. Lip 30 may extend substantially parallel to bottom wall 12. Inside the pan 10 there is a spiral rib 32. Rib 32 starts at the hub cup 14 and then travels a spiral path, first on the inner surface of bottom wall 12, and then on the inner surface of sidewall 28. Rib 32 terminates adjacent lip 30. In preferred form, the rib 32 is a thin wall which extends substantially parallel to the axis of rotation 34.

In use, separator pan 10 is oriented to lean backwards from vertical, with the lower portion of its sidewall 28 sloping downwardly as it extends outwardly from bottom wall 12, and with the rib 32 sloping upwardly as it extends outwardly from the interior of pan 10. This orientation is shown by FIG. 4. In use, the pan 10 is rotated while gold ore is introduced into the lower portion of the pan, generally along line 36. The downwardly sloping nature of the lower portion of sidewall 28 causes the larger particles of the ore to gravitate out from the pan 10. Also, water introduced into the pan washes out the light material. The heavy gold particles settle into the valley formed between rib 32 and the pan. The direction of rotation is such that smaller particles which fall onto the rib 32 are moved, as pan 10 rotates, along the rib into the hub cup 14. These small particles will include small gold particles which were in the gold ore.

Separator pan 10 may be constructed from any suitable material. In preferred form, it is constructed from a durable plastic material.

Figure 2:
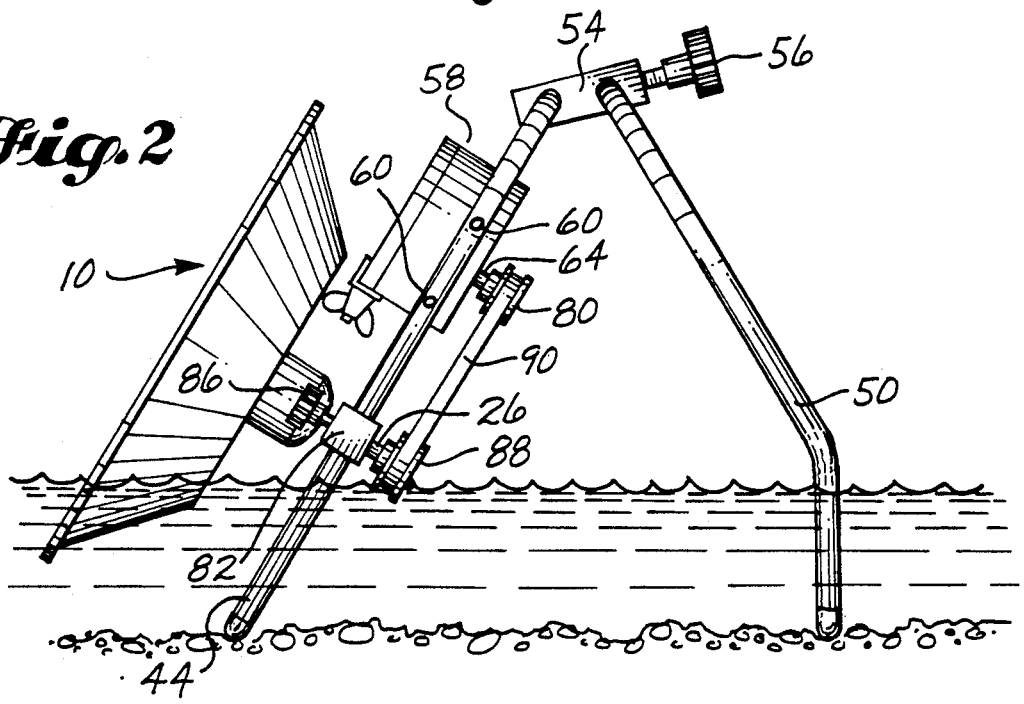
FIG. 2 is a side elevational view of the separator in its use position, shown within a shallow stream, with the separator pan disposed to lean backwards from vertical, and with the lower sidewall portion of the pan located in the water and disposed to slope downwardly as it extends outwardly from the bottom of the pan.
Figure 7:
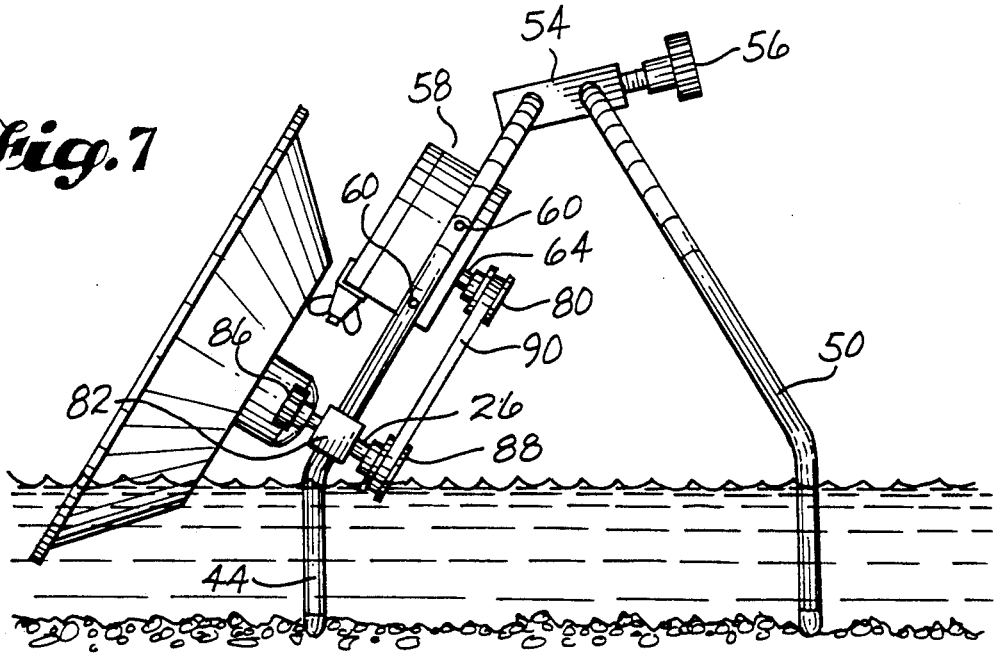
FIG. 7 is a view like FIG. 2 but showing a different configuration of the frame legs which are adjacent the pan.

In preferred form, the separator pan 10 is mounted onto a small frame which is movable between a use position (FIGS. 1, 2 and 5) and a folded position (FIG. 3), into which it is moved for transporting and stowage. In preferred form, the frame F comprises a first or front part 38 and a second or rear part 40. As best shown by FIGS. 1 and 5, the two frame parts 38, 40 have a substantially U-shape. Front frame part 38 comprises a pair of legs 42, 44 and an interconnecting top part or "bight" 46. In similar fashion, rear frame part 40 comprises a pair of legs 48, 50 and an interconnecting top part or "bight" 52. As shown by FIGS. 1 and 2, the lower portions of legs 48, 50 can be bent to extend at an angle to the upper portions of the legs 48, 50. The legs 42, 44 may be straight. In another embodiment (FIG. 7), the lower portions of legs 42, 44 may also be bent, so that all four legs 42, 44, 48, 50 have bent lower portions. All four legs 42, 44, 48, 50 are directed generally downwardly into the earth. This provides a very stable support for the pan 10. In still another embodiment, the legs 42, 44 may be bent and the legs 48, 50 may be straight. Also, it may be desirable to make all four legs 42, 44, 48, 50 straight. An advantage of bending the lower portions of legs 48, 50 is shown in FIG. 3. The bending of the legs 48, 50 makes the frame F more compact when it is in its folded condition.

The frame parts 38, 40 may be easily connected together by a connector block 54. Connector block 42 may be a solid block of plastic or other material in which two transverse openings are formed, one for top part 46 and the other for top part 52. A bolt 55 and a single set screw 56 may be provided for securing block 54 into position relative to frame part 52. Set screw 56 is loosened when it is desired to move the frame parts 38, 40 either together or apart. Then, it is tightened. Of course, any other suitable connector can be used for securing the two frame parts 38, 40 together. For example, a connector 54 may be used which is in the nature of a pair of housing parts, each with a pair of semi-cylindrical transverse grooves. One of these housing parts is placed below frame parts 46, 52, with the frame parts 46, 52 positioned within its semi-cylindrical grooves. Then, the second housing part is positioned down on top of the first housing part, with its semi-cylindrical grooves positioned over the frame parts 46, 52. Then, a screw is inserted to extend through the two frame parts. A wing nut or the like is positioned on the bolt and is used to tighten the bolt and pull the two frame parts together, into a clamping relationship with the frame parts 46, 52.

Figure 6:
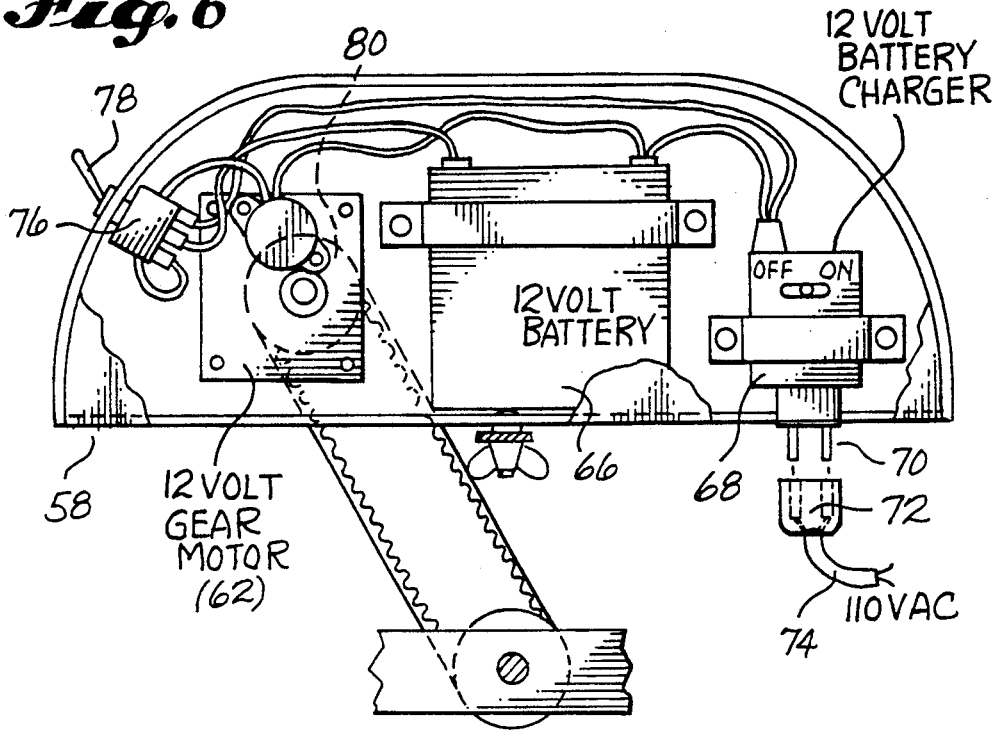
FIG. 6 is a fragmentary view showing components within a drive assembly housing, including a motor pulley, a pan pulley supported by a transverse frame member, and connected to the pan, and a drive belt interconnecting the two pulleys.

In preferred form, frame F is provided with a housing 58 which houses some of the drive components. As shown by FIGS. 1, 2 and 5, housing 58 extends between legs 42, 44. Housing 58 may be secured to legs 42, 44 by nut and bolt fasteners 60, or the like. As shown by FIG. 6, housing 58 includes a drive motor 62 which is preferably a twelve volt gear motor. It includes an output shaft 64 which extends outwardly through the back wall of the housing 58. Housing 58 also includes a twelve volt battery 66 which is preferably rechargeable. Housing 58 may also include a twelve volt battery charger 68 having a plug 70 which is connectable to a plug 72 on the end of a cord 74 leading to a source of 110 volt alternating current. Battery 66 may also be recharged by a solar energy powered recharger which may be mounted on housing 58 and used in addition to or in lieu of charger 68.

The battery 66, and the battery charger 68 (and/or the solar energy powered recharger) are a part of a control circuit which includes an off/on switch 76. Switch 76 includes a control arm 78 which is moved in a first direction to turn the switch 76 on and in an opposite direction to turn switch 76 off. As shown by FIGS. 2 and 3, motor shaft 64 is connected to a first pulley 80. In preferred form, a transverse frame member 82 extends between frame legs 42, 44, below housing 58. Frame member 82 may be constructed from plastic and may include an opening for each leg 42, 44. A pair of set screws 84, 86 may be provided for securing frame member 82 to the frame members 42, 44. Frame member 82 carries a suitable bushing for drive shaft 26. The rear end of drive shaft 26 is connected to a second pulley 88. Pulleys 80, 88 are interconnected by a drive belt 90. The tension in drive belt 90 may be easily adjusted by the user merely loosening set screws 84, 86 and then moving frame member 82 downwardly until the proper tension is in the drive belt 90. Then, the set screws 84, 86 are tightened for the purpose of securing frame member 82 in a set position. This will maintain the established tension that was set in the drive belt 90.

The operation will now be described: The set screw 46 is loosened and the two frame parts 38, 40 are spread apart, into the position shown by FIGS. 1, 2 and 5. Then, set screw 56 is tightened. The frame F can then be set into a shallow portion of a stream, in the manner shown by FIG. 2. As best shown by FIGS. 2 and 4, the pan 10 is in what may be termed a rearwardly leaning position. That is, pan 10 leans rearwardly from vertical. Its axis of rotation 34 extends at an oblique angle which is perpendicular to the general plane of pan 10. As best shown by FIG. 4, when pan 10 is in this position it presents a lower sidewall portion which slopes downwardly as it extends forwardly from bottom 12. As previously described, spiral rib 32 slopes upwardly as it extends axially from the interior of pan 10. Gold ore can be hand or shovel fed into pan 10, along path 36, while pan 10 is rotated to cause spiral rib 32 to wind inwardly. Large particles of the ore will gravitate out from pan 10, because the lower portion of sidewall 28 slopes downwardly. Small particles will be caught between the spiral rib 32 and sidewall 28 and bottom wall 12. These particles will be moved by the rotation along the spiral path of rib 32 and will deposited into the hub cup 14. Periodically the separator can be turned off and a pair of tweezers can be used for picking gold particles out from the hub cup 14.

In between use, the set screw 56 can be loosened and the rear frame part 40 moved forwardly into the position shown by FIG. 3. Then set screw 56 can be tightened to substantially hold the frame in the position shown by FIG. 3. As can be seen, the separator, when in its folded position, is relatively compact and can be easily transported. It can also be stowed in a relatively small amount of space.

In other embodiments a hand crank can be used for rotating the pan 10, in lieu of an electric motor. Also, the frame construction can vary considerably. The separator can be used to separate gold particles from dry ore. It is not necessary that it be used in water or with ore that has been subjected to water.

The example embodiments which have been described and illustrated are not to be used to limit the scope of protection. Rather, the scope of protection is to be determined by the claims which follow, interpreted in accordance with the established rules of patent claim interpretation, including use of the doctrine of equivalents.

What is claimed is:

1. A separator for separating gold particles from gold ore, comprising:

a rotatable gold pan including a bottom, a frusto-conical sidewall having a small diameter inner end connected to said bottom and a large diameter outer end, a hub cup at the center of the bottom, and a spiral rib inside said pan, spiraling inwardly from the outer end of the sidewall to said hub cup, first on the sidewall of the pan and then on the bottom of the pan;

a mounting frame for the pan, mounting said pan for rotation about an axis which extends axially through the hub cup and at an angle from horizontal, said mounting frame mounting the pan to lean backwards from vertical, with said sidewall having a lower extent which slopes downwardly and forwardly from said bottom;

wherein said hub cup has an open forward end where the cup intersects the bottom and a lower extent which slopes downwardly and rearwardly from said forward end;

wherein said spiral rib includes a radially inwardly directed surface which, below the hub cup, slopes forwardly and upwardly, both in the region of the sidewall and the region of the bottom;

wherein in use the pan is rotated in a direction causing particles on the spiral rib to be moved inwardly along the spiral rib to the hub cup;

wherein in use gold ore is introduced into the pan while the pan is rotating and large particles of the ore will gravitate radially of the pan, and move laterally across the rib and out from the pan, and small gold particles will be held by the rib and moved by the rib inwardly along the spiral path of the rib into the hub cup; and said frame comprising a top, front and rear portions extending downwardly from said top, and diverging apart as they extend downwardly, and said pan being mounted on said front portion, at a location below said top portion.

2. A separator according to claim 1, further comprising a drive motor for rotating the pan, said drive motor being positioned on a forward portion of the frame above the pan axis, and a drive transmission interconnecting the drive motor and the pan.

3. A separator according to claim 2, comprising an upper housing mounted on the forward portion of the frame, said drive motor being located within said upper housing, a transverse frame member on the forward portion of the frame below said housing, said transverse frame member serving to mount the pan for rotation, and wherein the transmission comprises a first pulley attached to the drive motor, within the upper housing, a second pulley attached to the pan, and a drive belt interconnecting the two pulleys.

4. A separator according to claim 2, wherein the front portion of the frame includes first and second legs and a top part interconnecting the first and second legs.

5. A separator according to claim 4, comprising a transverse frame member extending between and interconnecting the first and second legs of the front portion of the frame, said pan being mounted for rotation on said transverse frame member.

6. A separator according to claim 5, comprising a drive motor for rotating the pan, mounted on the front portion of the frame above the transverse frame member, and a drive transmission interconnecting the drive motor and the pan, with the drive motor being positioned above and rearwardly of the mounting location of the pan.

7. A separator according to claim 6, comprising and upper housing connected to the frame, above the transverse frame member, said drive motor being located within the upper housing, and wherein the transmission comprises a first pulley attached to the drive motor, a second pulley attached to the pan and a drive belt interconnecting the two pulleys.

8. A separator according to claim 7, wherein the rear portion of the frame includes third and fourth legs and a second top portion interconnecting the third and fourth legs, and said frame further including a connector means interconnecting the top portions of the front and rear frame portions, said connector means being operable to allow movement of the third and fourth legs towards the first and second legs, to collapse the frame for storage, and movement of the third and fourth legs away from the first and second legs, to establish an in-use position of the frame, in which the front and rear frame portions diverge apart from the connector means and the lower ends of the legs are spaced apart and provide a four point support for the frame and the pan supported by the frame.

* * * * *